United States Patent [19]

Webber

[11] 4,414,926

[45] Nov. 15, 1983

[54] ENGINE PRESSURE-VACUUM COOLING SYSTEM WITH A HORIZONTAL COOLANT STORAGE TANK

[76] Inventor: Robert C. Webber, 908 Holoma Dr., Indian River Shores, Fla. 32960

[21] Appl. No.: 304,832

[22] Filed: Sep. 23, 1981

[51] Int. Cl.[3] ..... F01P 11/18

[52] U.S. Cl. ..... 123/41.15; 123/41.27; 220/203

[58] Field of Search ..... 123/41.01, 41.02, 41.15, 123/41.27, 41.54; 220/202, 203

[56] References Cited

U.S. PATENT DOCUMENTS

| | | | |
|---|---|---|---|
| 2,597,061 | 5/1952 | Burich | 123/41.15 X |
| 2,841,127 | 7/1958 | Baster | 123/41.27 X |
| 3,292,427 | 12/1966 | Mattson | 123/41.15 |
| 3,397,808 | 8/1968 | Jones | 123/41.15 |
| 3,576,181 | 4/1971 | Neal et al. | 123/41.54 |
| 3,601,181 | 8/1971 | Avrea | 123/41.27 X |

*Primary Examiner*—William A. Cuchlinski, Jr.
*Attorney, Agent, or Firm*—Julian C. Renfro

[57] ABSTRACT

An engine pressure-vacuum cooling system with a horizontal coolant storage tank wherein the cooling system is pressurized during engine operation and maintained under vacuum when the engine is inoperative. After filling the system with coolant, during the initial engine warm-up cycles air is purged through a one-way valve and the cooling system thereafter sealed against further entry of air. The storage tank includes a means for confining sludge and other debris to the tank and a means for warning when the system vacuum exceeds a predetermined level.

3 Claims, 7 Drawing Figures

ENGINE PRESSURE-VACUUM COOLING SYSTEM WITH A HORIZONTAL COOLANT STORAGE TANK

BACKGROUND OF THE INVENTION

This application relates back to my co-pending application for an engine pressure-vacuum cooling system, Ser. No. 256,944, filed Apr. 23, 1981.

The invention, as disclosed in the co-pending application, is constituted by including in an engine cooling system; means for purging the air and preventing reentry thereof, a coolant storage tank of volume determined by an established ratio of tank to system volumes, a means for maintaining the system under pressure when the engine is in operation, and a means for maintaining the system under vacuum when the engine is inoperative. In addition, means are provided for confining sludge and other debris to the tank and for warning when the system vacuum exceeds a pre-determined level. Tests have shown this concept to be a significant improvement over current practice wherein coolant is allowed to diminish and air permitted to remain and enter through a vacuum relief means.

In the co-pending application, the coolant storage tank is configured for vertical mounting, thereby requiring a space having adequate height as compared to breadth. It has been observed that in some existing engine installations, the height of the space, available for mounting the storage tank, is rather small as compared to the breadth. Thus, in some cases a horizontally mounted tank of breadth greater than height may be preferable over the tank configuration disclosed in my co-pending application.

To the end that my inventive concept may be compatible with engine installations where a horizontally mounted tank is either more convenient or required, it is an object of the present invention to provide in a pressure-vacuum engine cooling system an elongated coolant storage tank which is particularly configured for horizontal mounting.

It is a further object to provide in an elongated storage tank which is horizontally mounted a means for confining sludge and other debris so as not to contaminate the remaining portion of the cooling system.

The foregoing objects, along with additional objects, features, advantages and benefits, become more apparent in the ensuing description and accompanying drawings which disclose the invention in detail. A preferred embodiment is disclosed and the subject matter to which exclusive property rights are claimed is set forth in each of the numbered claims following the description.

DESCRIPTION OF THE PREFERRED EMBODIMENT

Figure 1:
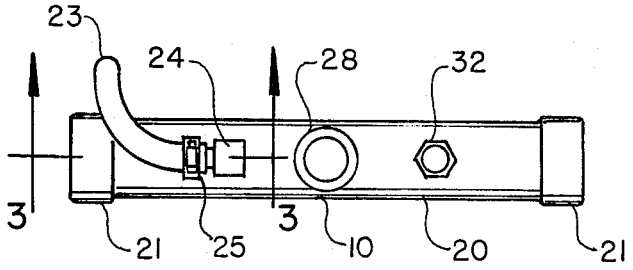
FIG. 1 is a plan view of a coolant storage tank for a pressure-vacuum cooling system.
Figure 2:
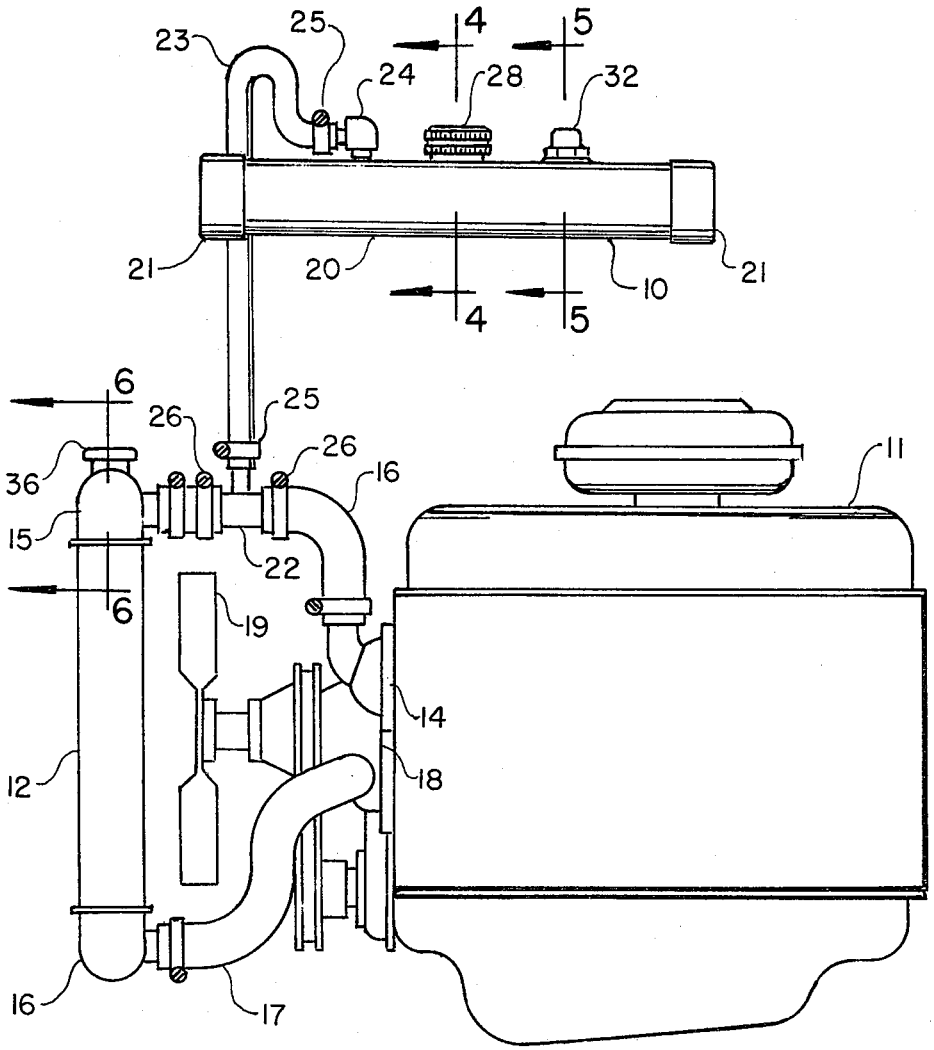
FIG. 2 is a side elevation view showing the overall arrangement of the elements of the present invention, including, the coolant storage tank shown in FIG. 1.

Referring now to the accompanying drawings, wherein like numerals designate like and corresponding parts throughout the several views, the overall arrangement of the present invention is shown in FIG. 2 as being similar to my co-pending application except for the configuration and orientation of the coolant storage tank 10. The tank 10, which in itself is believed to be novel for an engine cooling system, will be described later in detail.

The engine 11 is a conventional water cooled design, used for such purposes as powering motor vehicles and stationary industrial uses. The radiator 12, also of conventional design, is operatively connected to the engine 11 in a cooling circuit in which a liquid 13, preferably a 50/50 mixture of ethylene glycol and water, flows back and forth between the engine 11 and the radiator 12.

After circulating through the engine, the coolant 13, whose temperature has been raised from absorption of engine heat, exits the engine 11 through the outlet elbow 14 and enters the top tank 15 of the radiator 12 via the inlet hose 16 and flows downwardly through passages, not shown, to the bottom tank 16 of the radiator 12.

The coolant 13, at reduced temperature, exits the radiator 12 via the outlet hose 17 and enters the low pressure side of the engine driven water pump 18. The pump 18 circulates the coolant 13 through the system and a thermostat and by-pass circuit, internal to the engine and not shown, control the temperature of the coolant by regulating the flow from the engine 11 to the radiator 12. The engine driven fan 19, also of conventional design, flows air through the radiator 12, to increase heat transfer from the coolant 13.

The foregoing description, also applicable to current cooling systems, is provided for the purpose of supplying a foundation for understanding the use and non-obviousness of the present invention. Heretofore, in addition to the above, modern cooling systems have generally included a two-way valve for pressure relief at a pre-set maximum system pressure and vacuum relief at a maximum pre-set system vacuum. This arrangement has adversely affected cooling system performance by an unreplenished coolant loss from coolant volume expansion and the admission of air during coolant volume contraction. Furthermore, it has been widely accepted by others skilled in the art that some form of vacuum relief is mandatory with a pressurizied cooling system to prevent damage from coolant volume contraction during engine shut-down. As will be noted, the instant invention does not follow current practice since the vacuum relief means has been eliminated with the invention.

Referring once again to FIG. 2, the coolant storage tank 10 has an elongated cylindrical shape with a length to diameter ratio of about 5, particularly suitable for mounting the tank in a space having limited height. The tank 10 may be constructed from a common material using a sufficient wall thickness for notwithstanding system vacuum and pressures. The material should be capable of withstanding a maximum temperature of about 300° F. and of providing a corrosion resistant, leakproof enclosure. Although in the drawings the tank 10 is depicted as constructed by joining to the metal tubular center section 20 the end caps 21, it is apparent that the above requirements may be met by other means, such as, a molded temperature resistant plastic enclosure.

As disclosed in my co-pending application, the tank 10 is sized to preferably provide a storage volume of about one eighth the coolant volume for the remaining portion of the cooling system. Thus, about an eight pint capacity would be used when the invention is adapted to an existing system having about 70 pints of coolant.

The means shown in the drawings for installing the tank 10 is particularly convenient when adapting the inventive concept to existing engine installations. The radiator inlet hose 16 is divided into two parts and the T-connector 22 inserted therebetween to permit a coupling of the tank hose 23 with the radiator hose 16. The other end of the tank hose 23 is connected to the L-connector 24 which extends through the wall of the tank center section 20. Hose clamps 25, 26 are used at each of the hose connections to insure leaktight joints. It is obvious that when the present invention is part of some original equipment, in lieu of the T-connector 22, a special fitting may be provided at other locations for attachment of the hose 23.

Figure 3:
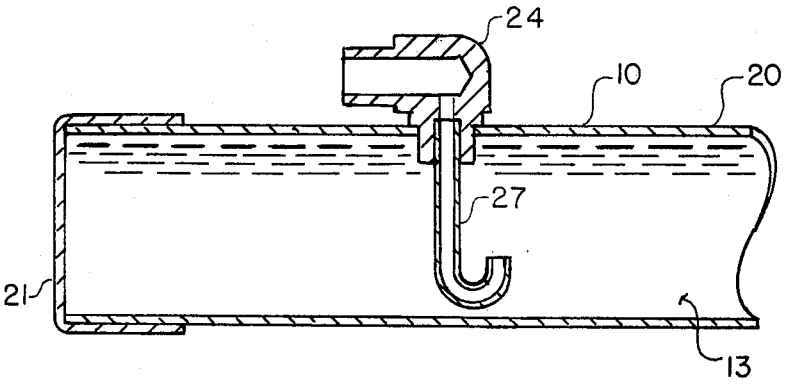
FIG. 3 is a sectional view, drawn to an enlarged scale, taken on the line 3—3 of FIG. 1, showing the outlet structure of the coolant storage tank.
Figure 4:
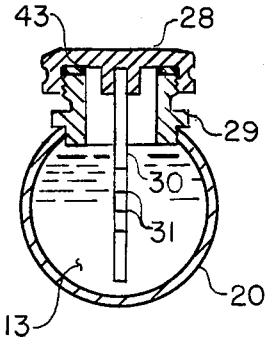
FIG. 4 is a sectional view, drawn to an enlarged scale, taken on the line 4—4 of FIG. 2, showing the means for filling and indicating coolant level of the storage tank.

Referring now to FIG. 3, within the interior of the tank 10, the U-tube 27 is attached to the L-connector 24 and is positioned such that the opening of the tube 27 is upward facing and spaced above the bottom of the tank 10. Thus, it is seen that coolant is withdrawn from the upper portion of the tank 10 and that agitation is reduced at the lower portion of the tank 10. As a result of these effects, sludge and other undesirable debris are confined within the coolant storage tank 10.

Adjacent to the L-connector 24 at the top of the tank 10, is the fill cap 28, in threaded engagement with the connector 29 which extends into the interior of the tank 10. The gasket 43, attached to the inside surface of the cap 28, seals the cap 28 to the connector 29. Projecting downwardly from the center of the cap 28 is the blade shaped indicator 30, with suitable markings 31 for determining the amount of coolant 13 in the tank 10.

Figure 5:
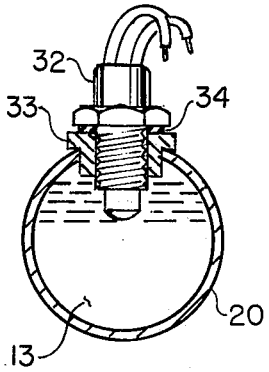
FIG. 5 is a sectional view, drawn to an enlarged scale, taken on the line 5—5 of FIG. 2, showing the warning means for indicating when the system vacuum exceeds a pre-determined level.

Referring now to FIG. 5, the vacuum switch 32 is shown in threaded engagement with the connector 33 and sealed against the connector 33 by the gasket 34. The switch 32, preferably of conventional design, provides a warning by actuating an audio or video device, not shown, in the event of a malfunction, such as, excessive loss of coolant 13.

Figure 6:
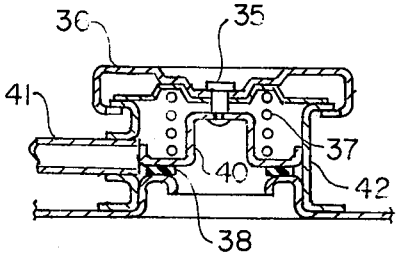
FIG. 6 is a sectional view, drawn to an enlarged scale, showing the one-way pressure relief valve in the closed position.
Figure 7:
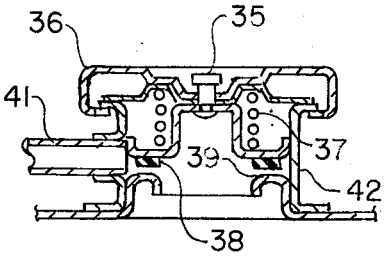
FIG. 7 is a sectional view which is similar to FIG. 6, showing the pressure relief valve in the open position.

The pressure relief valve 35, previously disclosed in my co-pending application, is depicted in detail in FIGS. 6 and 7. The valve preferably limits the system pressure to about 15 psig. Integral with the radiator cap 36, the valve 35 is actuated by a compression spring 37 when the system pressure reaches the pre-set relief valve pressure. In FIG. 6 the relief valve 35 is shown in the normally closed operating condition. The spring 37 is in an extended position and the seal 38 is tightly pressed against the seat 39 of the radiator 12. At the pre-set relief pressure, the spring 37 is compressed as shown in FIG. 7 by pressure acting against the valve sleeve 40 and the seal 38 is displaced from the seat 39, allowing a flow of coolant 13 through the tube 41 projecting from the side of the radiator filler neck 42.

It should be noted that unlike current systems, no provisions exist in the valve 35 or other portions of the present invention for vacuum relief.

The manner of using the present invention is as follows. After filling the system with coolant, during engine operation, the coolant undergoes a volume expansion and rise in pressure as a result of the increased coolant temperature caused by absorption of engine heat. Also, the solubility of air in the coolant is reduced by the increased coolant temperature, thus tending to drive the air from the coolant 13. After a sufficient rise in system pressure, the relief valve 35 opens, purging the air from the system with some accompanying coolant 13. The coolant loss is made up by coolant flow from the storage tank 10.

The relief valve 35 then closes, sealing off the system from further entry of air. After engine shut down the coolant temperature and pressure are decreased and the system is maintained under vacuum until the engine is again restarted.

Thus, it is seen that a pressure-vacuum cooling system for an engine has been provided which has an elongated storage tank particularly configured for horizontal mounting in a space having a relatively small height. In addition, the system includes a means for confining sludge and other debris to the tank and the numerous other benefits and features of my co-pending application.

Although but one embodiment for the invention has been described herein, it is obvious that many changes may be made in size, shape, arrangement and details of the various elements without departing from the spirit thereof.

I claim:

1. A pressure-vacuum cooling system for an internal combustion engine equipped with a radiator, wherein the cooling system may have on occasion a pressure less than atmospheric pressure, said invention comprising a connector for liquid interposed between the engine and the radiator, through which connector liquid coolant flows when the engine is operating, conduit means attached to said connector and to an elongate storage tank for coolant, the long axis of which tank is horizontally disposed, said conduit means forming a path for liquid coolant to flow on occasion between said radiator and engine on the one hand, and said storage tank on the other hand, a removable cap which, when removed, enables additional liquid, when needed, to be added to said cooling system, said cap having therein a one-way valve set to open in the pressure range of between 10 and 20 pounds per square inch when the engine is operating and the coolant has been heated thereby, said cap, when in place, effectively preventing the admission of any atmospheric air to the cooling system after the engine has thereafter ceased operation and the liquid coolant has cooled, and means for warning when the internal pressure of the system has reached a certain established point less than atmospheric pressure.

2. The cooling system for an internal combustion engine as defined in claim 1 in which said removable cap is operatively disposed on the radiator, and an additional cap operatively disposed on said horizontally disposed storage tank, such that coolant liquid can be added to said storage tank when needed, and liquid level measuring means associated with said additional cap, enabling an operator to determine when additional coolant should be added.

3. The cooling system as defined in claim 1 in which said coolant tank has a fill tube that is generally U-shaped, with the open end of said tube spaced above the bottom of said storage tank so as to minimize the sucking up of any sludge that may be residing at the bottom of said tank.

* * * * *